US007147198B2

(12) United States Patent
Lin et al.

(10) Patent No.: US 7,147,198 B2
(45) Date of Patent: Dec. 12, 2006

(54) WAX PATTERN FOR MAKING A GOLF CLUB HEAD

(75) Inventors: Chon-Chen Lin, Ping-Tung Hsien (TW); Yen-Chi Hsu, Ping-Tung Hsien (TW)

(73) Assignee: O-Ta Precision Industry Co. Ltd., Ping-Tung Hsien (TW)

( * ) Notice: Subject to any disclaimer, the term of this patent is extended or adjusted under 35 U.S.C. 154(b) by 385 days.

(21) Appl. No.: 10/877,631

(22) Filed: Jun. 24, 2004

(65) Prior Publication Data

US 2005/0284597 A1 Dec. 29, 2005

(51) Int. Cl.
*B22C 7/02* (2006.01)

(52) U.S. Cl. ..... 249/52; 249/62; 425/DIG. 12; 164/235

(58) Field of Classification Search ..... 249/52, 249/62; 425/DIG. 12; 164/34, 45, 235
See application file for complete search history.

(56) References Cited

U.S. PATENT DOCUMENTS

| | | | | |
|---|---|---|---|---|
| 5,346,218 | A * | 9/1994 | Wyte | 473/346 |
| 5,547,630 | A * | 8/1996 | Schmidt | 264/297.2 |
| 6,830,093 | B1 * | 12/2004 | Bramley | 164/34 |
| 2005/0224207 | A1 * | 10/2005 | Huang | 164/35 |
| 2005/0258568 | A1 * | 11/2005 | Hou | 264/225 |

* cited by examiner

*Primary Examiner*—Donald Heckenberg
(74) *Attorney, Agent, or Firm*—Shirley L. Church

(57) ABSTRACT

A wax pattern for use in making a golf club head has a shell wall which defines a hollow region and which includes a front portion, a rear displacement portion and a dividing line extending between the front and rear displacement portions. The wax pattern has a profile conforming to that of the golf club head. A metal blank having the same shape and size as the wax pattern is made by using the wax pattern. The blank is then cut along a dividing line to remove a rear displacement portion thereof so as to form a metal part for making the golf club head.

5 Claims, 5 Drawing Sheets

WAX PATTERN FOR MAKING A GOLF CLUB HEAD

BACKGROUND OF THE INVENTION

1. Field of the Invention

This invention relates to a wax pattern for precision casting a metal blank which is used to make a golf club head.

2. Description of the Related Art

Among the processes for making golf clubs and their accessories, forming a golf club head is the most complicated technology which is expensive and requires accuracy. Generally, golf club heads are classified as iron heads, wood heads and putters.

A typical process for making a golf club head is divided into an anterior part and a posterior part. The anterior part is related to precision casting which includes the steps of preparing a die, injecting wax into the die to form a wax pattern, mounting the wax pattern on a support, dipping the wax pattern into a slurry for forming a mold over the wax pattern, melting out the wax from the mold, pouring a molten metal into the mold to form a metal blank, and subjecting the metal blank to cutting, heat treating and finishing processes.

FIG. 1 shows a wax pattern 1 for forming a golf club head, such as, a wooden head, which is produced by forming wax in a die. A metal blank 2' is made by using a mold (not shown) which is formed over the wax pattern 1. The posterior part of the process for making the golf club head relates to a semi-automatic mechanical technology for processing the metal blank 2' wherein the metal blank 2' is subjected to grinding, washing, spray coating, stamping, etc., followed by the steps of assembling with a striking panel 3 to form a semi-finished product and finishing the semi-finished product, such as torque testing, polishing and packaging, etc. Reference numeral 4 denotes the final product, i.e. a golf club head 4.

In making a composite golf club head which is composed of metal and carbon fiber, the blank 2' which is made of a metal is subjected to a stamping process to cut out an unnecessary part of the blank 2', thus forming a metal part 2. The metal part 2 is then coupled with a carbon fiber reinforced plastic part 21 which has a shape corresponding to the extra part cut out from the blank 2', thereby forming the golf club head 4. However, since accuracy is required during the step of cutting out the unnecessary part of the blank 2' and since the blank 2' is not provided with any mark or line to indicate where the blank 2' is to be cut, difficulties are encountered during the stamping and cutting operations of the blank 2'. This results in increased production costs and increased defect products. An improvement in the processing of a metal blank for making a golf club head is therefore desirable.

SUMMARY OF THE INVENTION

An object of the present invention is to provide an improved wax pattern for forming a metal blank of a golf club head, by which the manufacturing of the golf club head can be facilitated.

According to this invention, a wax pattern is provided for making a golf club head having a metal part and a non-metal part. The metal part has a front striking face, a sidewall extending rearwardly from the front striking face, and a neck projecting outward from the sidewall. The wax pattern comprises a one-piece shell body including a shell wall confining a hollow region. The shell wall has a front portion, a rear displacement portion, a dividing line provided between the front portion and the rear displacement portion and dividing the shell wall into the front portion and the rear displacement portion. The front portion includes a front wall conforming in shape to the front striking face of the metal part of the golf club head, a lateral wall conforming in shape to the sidewall of the metal part and extending rearwardly from the front wall around the hollow region, and a neck projecting outward from the lateral wall and conforming in shape to the neck of the metal part. The dividing line extends in the shell wall and loops around the hollow region. The rear displacement portion is disposed rearwardly of the dividing line and extends rearwardly from the lateral wall.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
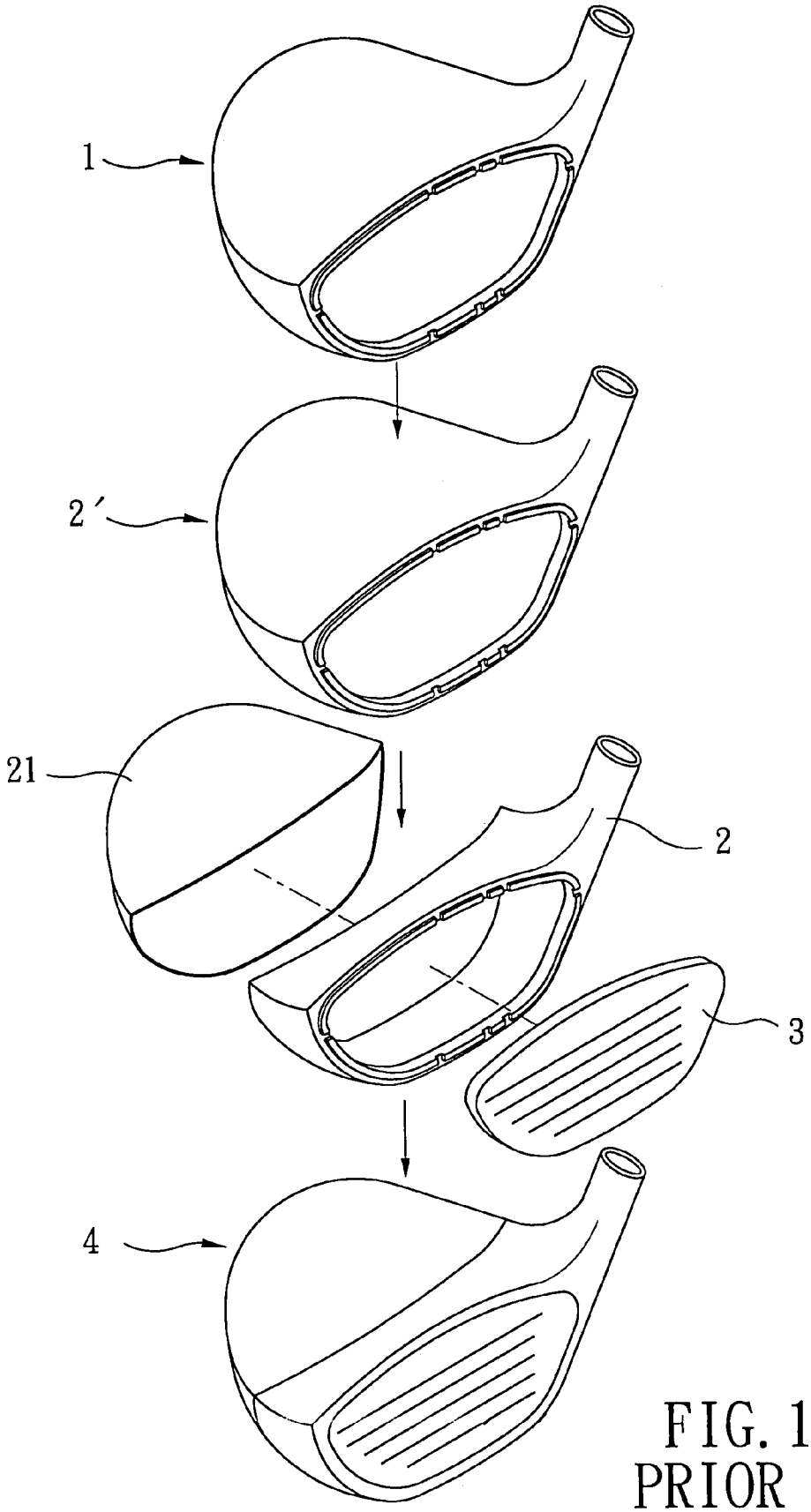
FIG. 1 PRIOR ART
FIG. 1 is a schematic view illustrating how a golf club head is made by using a conventional wax pattern.
Figure 2:
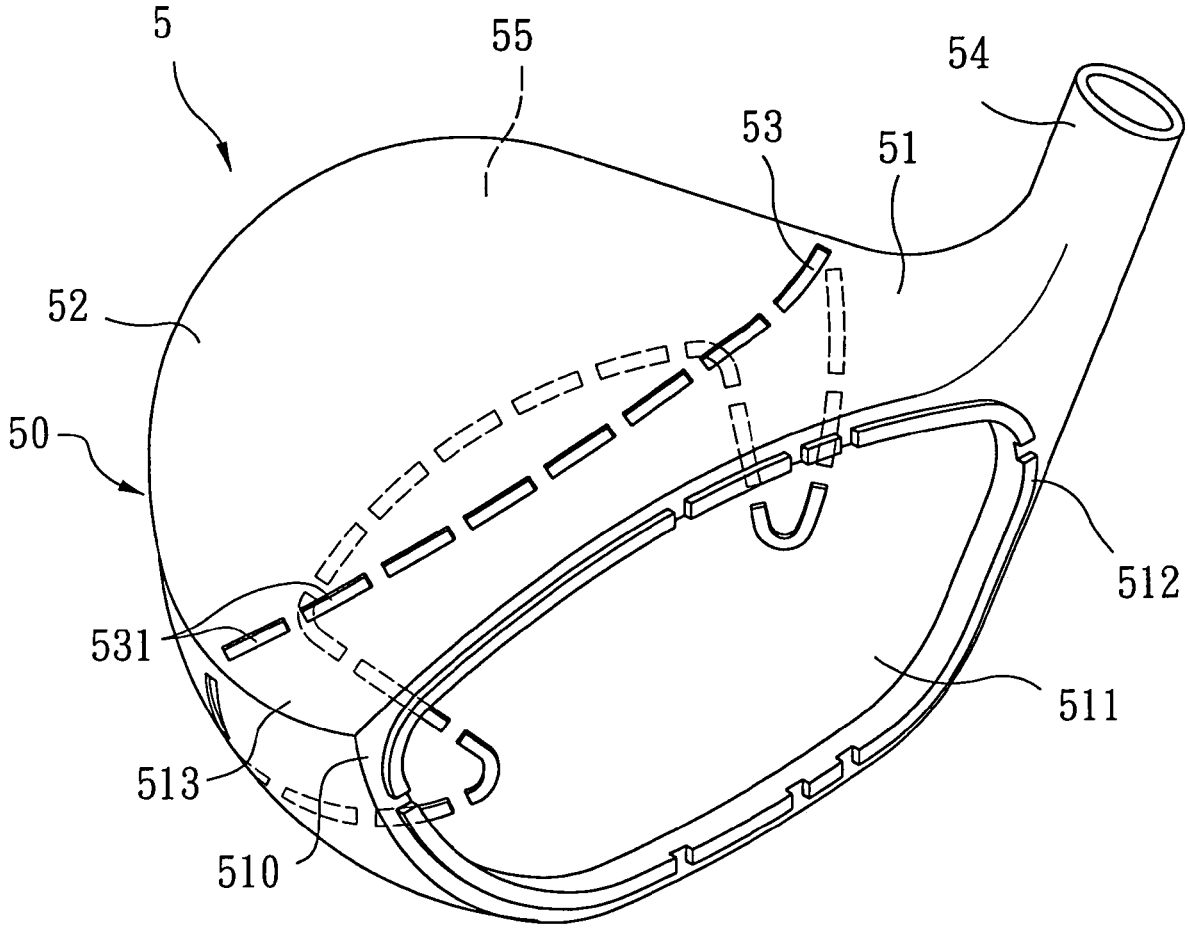
FIG. 2 is a preferred embodiment of a wax pattern according to the present invention.

Referring to FIG. 2, a preferred embodiment of the present invention is shown to include a wax pattern 5 formed as a one-piece shell body which has a shell wall 50 defining a hollow region 55. The shell wall 50 includes a front portion 51, a rear displacement portion 52, and a dividing line 53 that is provided in the shell wall 50 between the front portion 51 and the rear displacement portion 52 to divide the shell wall 50 into the front portion 51 and the rear displacement portion 52.

The front portion 51 has a front wall 510 formed with a front opening 511 and a flange 512 projecting forwardly from the front wall 510 and extending along the edge of the front opening 511. A lateral wall 513 extends rearwardly from the front wall 510 around the hollow region 55 of the shell wall 50. A neck 54 is configured as an open-ended tube which extends upwardly and inclinedly from the lateral wall 513.

The rear displacement part 52 has a rounded shape. The dividing line 53 is provided in the shell wall 50 and loops around the hollow region 55. The dividing line 53 is formed by a plurality of spaced apart apertures 531 which are provided in the shell wall 50 and which are oriented along the dividing line 53. In this embodiment, the shell wall 50 is a closed shell wall which opens only at the front opening 511 and at the end of the neck 54.

Figure 3:
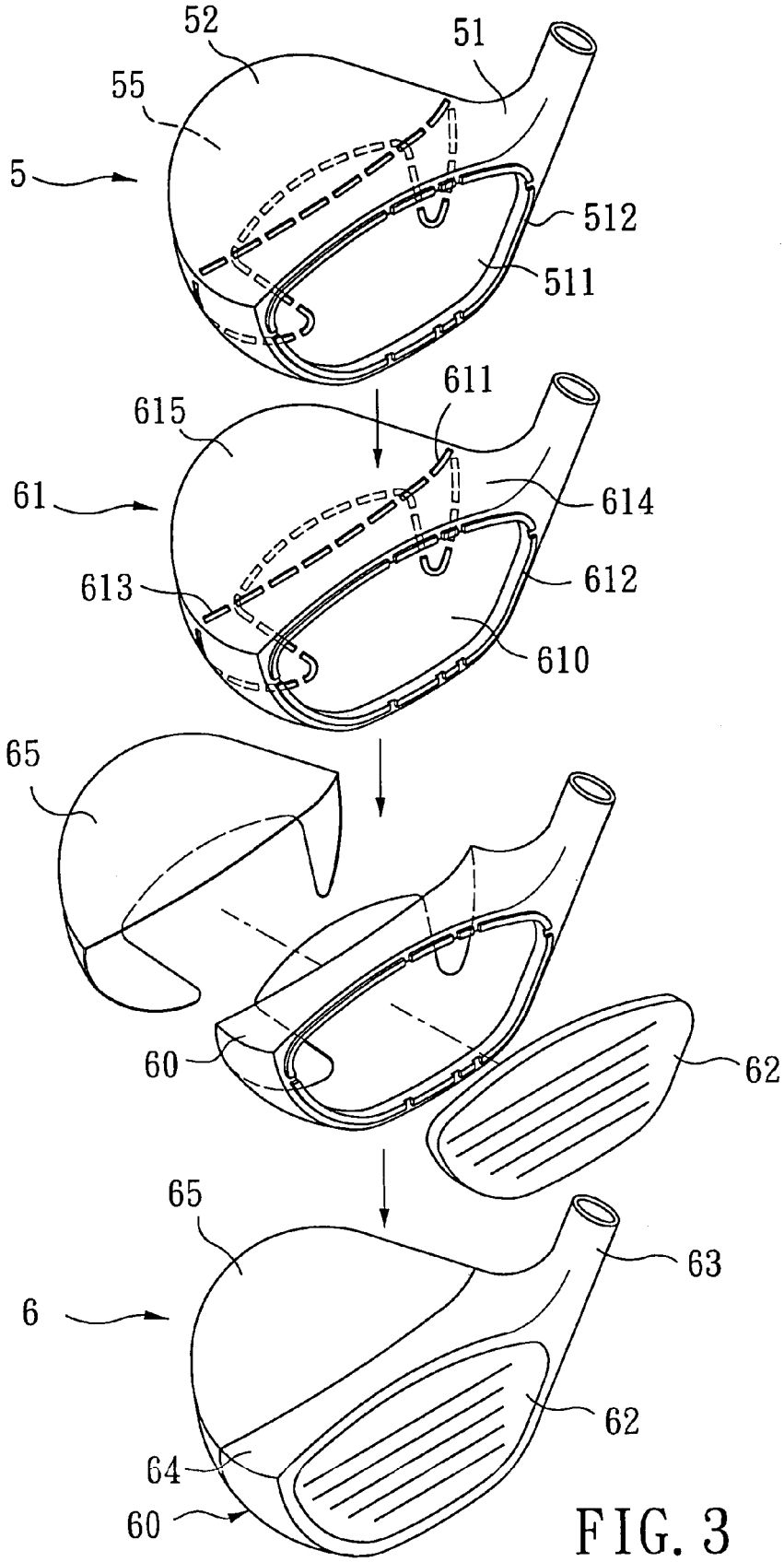
FIG. 3 is a schematic view illustrating how a golf club head is made by using the wax pattern of FIG. 2.

FIG. 3 illustrates a process for manufacturing a golf club head 6. The golf club head 6 includes a metal part 60, and a non-metal part or a carbon fiber reinforced plastic part 61. The metal part 60 has a front striking plate 62 at a front face thereof, and a neck 63 projecting outwardly from a sidewall 64 of the metal part 60 for the insertion of a shaft (not shown) thereinto.

The process for fabricating the golf club head 6 using the wax pattern 5 of the present invention is a conventional precision casting process which includes the steps of preparing a die, injecting wax into the die to form the wax pattern 5, mounting the wax pattern 5 on a support, dipping the wax pattern 5 into a slurry to form a mold over the wax pattern 5, melting out the wax from the mold, and casting a metal in the mold to form a blank 61. The resultant blank 61 is then subjected to the cutting, heat-treating, and finishing processes to form the golf club head 6.

Particularly, the wax pattern 5 is formed in such a manner that the shell wall 50 thereof has a shape conforming to that of the golf club head 6. The front portion 51 of the shell wall 50 has the same shape and size as the metal part 60 of the golf club head 6. In particular, the front wall 510 of the wax pattern 5 conforms in shape to the front face of the metal part 60 of the golf club head 6, the lateral wall 513 of the wax pattern 5 conforms in shape to the sidewall 64 of the metal part 60, and the neck 54 of the wax pattern 5 conforms in shape to the neck 63 of the metal part 60.

The blank 61 made by the precision casting process also has the same shape and size as those of the wax pattern 5, and is formed with a dividing line 611 conforming to the dividing line 53 of the wax pattern 5. The dividing line 611 is formed by a plurality of apertures 613. The blank 61 further includes a front opening 610 conforming to the front opening 511 of the wax pattern 5 and a flange 612 conforming to the flange 512 of the wax pattern 5. The metal part 60 of the golf club head 6 is made by cutting the blank 61 along the dividing line 611 to thereby divide the blank 61 into a front portion 614 and a rear displacement portion 615. After the rear displacement portion 615 is removed from the front portion 614, the front portion 614 is used as the metal part 60 of the golf club head 6. Thereafter, a carbon fiber-reinforced plastic part 65 is assembled with the front portion 614 in a conventional manner, and the striking plate 62 is attached to the flange 612 of the front portion 614 through a processing step to cover the front opening 610.

With the dividing line 53 provided in the wax pattern 5, the blank 61 can be formed with the dividing line 611. Since the blank 61 is provided with the dividing line 611 and since the dividing line 611 is formed by the apertures 613, a stamping device is permitted to cut easily and accurately the blank 61 along the dividing line 611, thereby facilitating the stamping operation, improving the cutting accuracy and enhancing the quality product rate. The problems encountered during the stamping operation can thus be alleviated.

Figure 4:
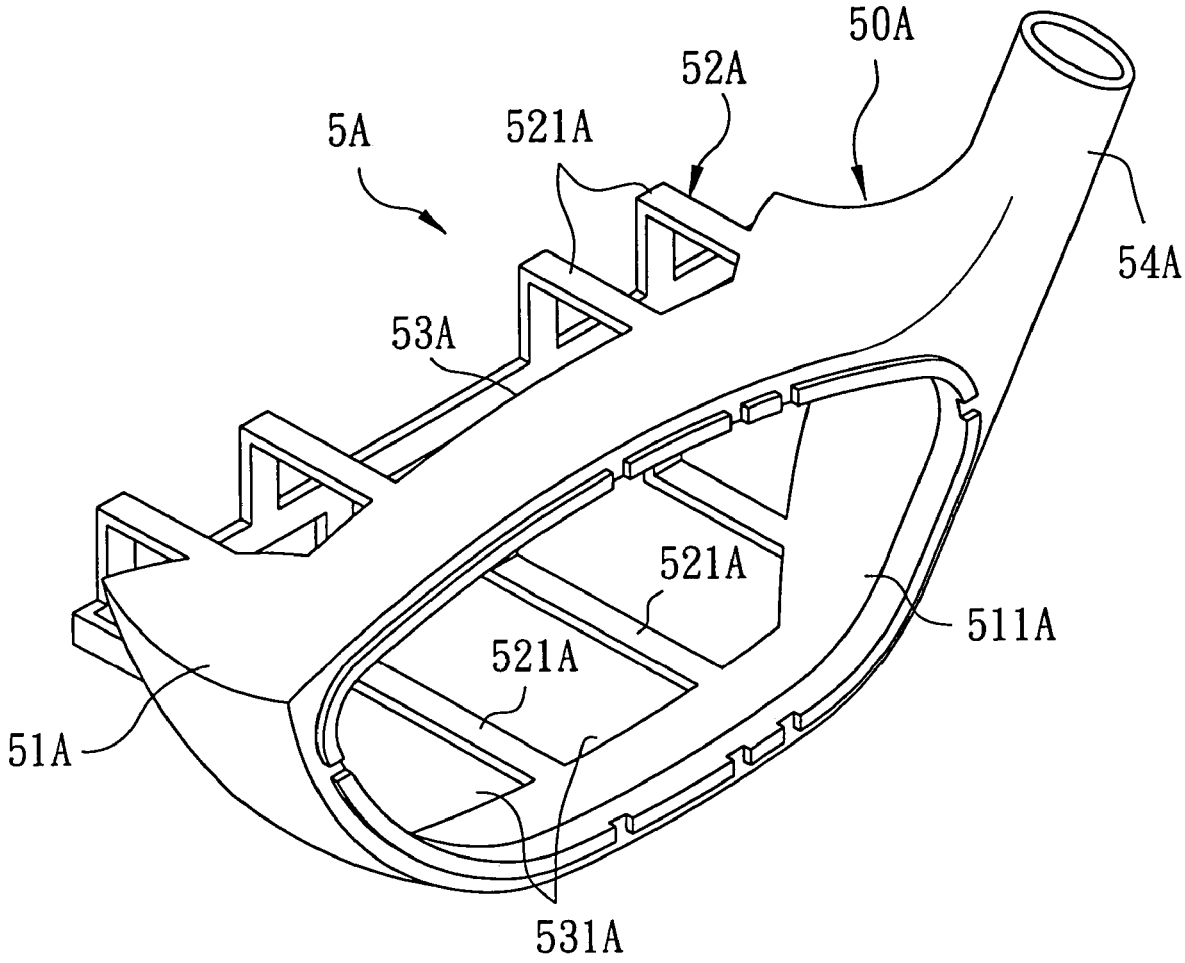
FIG. 4 is another preferred embodiment of a wax pattern according to the present invention.
Figure 5:
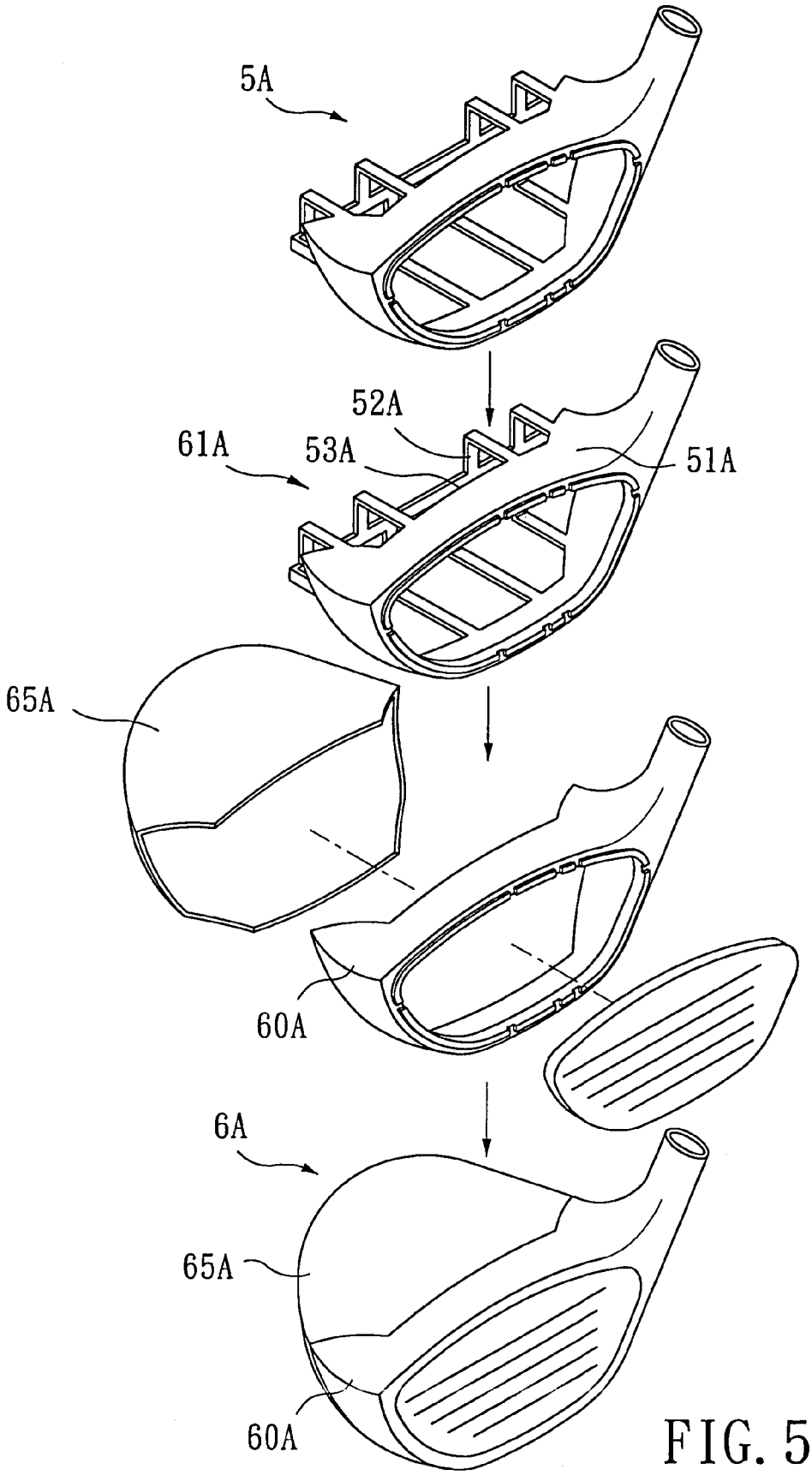
FIG. 5 is a schematic view illustrating how a golf club head is made by using the wax pattern of FIG. 4.

Referring to FIGS. 4 and 5, another preferred embodiment of the present invention includes a wax pattern 5A. The wax pattern 5A includes a shell wall 50A which has a dividing line 53A extending between a front portion 51A and a rear displacement portion 52A. The rear displacement portion 52A is an open structure formed by a plurality of spaced apart bars 521A which are interconnected. The dividing line 53A includes a plurality of apertures 531A formed among the bars 521A. Portions of the apertures 531A are oriented along the dividing line 53A.

As shown in FIG. 5, a blank 61A is formed by using the wax pattern 5A. Then, the rear displacement portion 52A is cut out from the front portion 51A along the dividing line 53A to serve as a metal part 60A. The metal part 60A is assembled to a plastic part 65A to form a golf club head 6A.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

We claim:

1. A wax pattern for making a golf club head having a metal part and a non-metal part, the metal part having a front striking face, a sidewall extending rearwardly from the front striking face, and a neck projecting outward from the sidewall, the wax pattern comprising:

a one-piece shell body having a shell wall confining a hollow region;

said shell wall having a front portion, a rear displacement portion, a dividing line provided between said front portion and said rear displacement portion and dividing said shell wall into said front portion and said rear displacement portion;

said front portion including a front wall conforming in shape to the front striking face of the metal part of the golf club head, a lateral wall conforming in shape to the sidewall of the metal part and extending rearwardly from said front wall around said hollow region, and a neck projecting outward from said lateral wall and conforming in shape to the neck of the metal part;

said dividing line extending in said shell wall and looping around said hollow region; and said rear displacement portion being disposed rearwardly of said dividing line and extending rearwardly from said lateral wall.

2. The wax pattern as claimed in claim 1, wherein said front wall has a front opening, and said neck is formed as an open-ended tube.

3. The wax pattern as claimed in claim 2, wherein said shell wall is a substantially closed shell wall which has a shape generally conforming to the golf club head and which opens only at said front opening and at said tube.

4. The wax pattern as claimed in claim 2, wherein said rear displacement portion of said shell wall is an open structure which is formed by a plurality of interconnected and spaced apart bars and which is connected to said lateral wall of said front portion.

5. The wax pattern as claimed in claim 1, wherein said dividing line includes a plurality of spaced apart apertures which are oriented along said dividing line.

* * * * *